US008229334B2

(12) United States Patent
Itabashi

(10) Patent No.: US 8,229,334 B2
(45) **Date of Patent: *Jul. 24, 2012**

(54) DEVELOPER UNIT, PROCESS DEVICE AND IMAGE FORMING APPARATUS

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1002 days.

This patent is subject to a terminal disclaimer.

(21) Appl. No.: 12/146,846

(22) Filed: Jun. 26, 2008

(65) Prior Publication Data

US 2009/0003889 A1 Jan. 1, 2009

(30) Foreign Application Priority Data

Jun. 29, 2007 (JP) ..... 2007-173533

(51) Int. Cl.
*G03G 15/08* (2006.01)

(52) U.S. Cl. ..... 399/279; 399/281

(58) Field of Classification Search ..... 399/253, 399/254, 279, 281

See application file for complete search history.

(56) References Cited

U.S. PATENT DOCUMENTS

| | | | | |
|---|---|---|---|---|
| 5,333,040 | A | 7/1994 | Imamiya | |
| 5,594,198 | A * | 1/1997 | Ikeda et al. | 399/281 |
| 7,764,911 | B2 * | 7/2010 | Itabashi | 399/281 |

FOREIGN PATENT DOCUMENTS

| | | | |
|---|---|---|---|
| JP | 63-085652 | | 4/1988 |
| JP | 2205875 | A | 8/1990 |
| JP | 04-050979 | | 2/1992 |
| JP | 05-061299 | | 3/1993 |
| JP | 05-088536 | | 4/1993 |
| JP | 6-318013 | | 11/1994 |
| JP | 7-333969 | | 12/1995 |
| JP | 8006387 | A | 1/1996 |
| JP | 08-202143 | | 8/1996 |
| JP | 9080885 | A | 3/1997 |
| JP | 11-249428 | | 9/1999 |
| JP | 2004-118121 | | 4/2004 |

OTHER PUBLICATIONS

Office action dated Jun. 9, 2009, for Japanese application P2007-173533.

* cited by examiner

*Primary Examiner* — David Gray
*Assistant Examiner* — Erika J Villaluna
(74) *Attorney, Agent, or Firm* — Banner & Witcoff, Ltd.

(57) ABSTRACT

A developer unit according to one aspect of the invention includes: a developer accommodation member configured to accommodate a developer having charging polarity to a first polarity opposite to a second polarity; a developing roller arranged at the developer accommodation member, the developing roller being configured to carry the developer; a supply roller arranged at the developer accommodation member and configured to supply the developer to the developing roller, an image formation width being defined on a surface of the supply roller along an axis direction of the supply roller; and a charging member brought into sliding contact with an outside of the image formation width of the supply roller. The charging member at a portion brought into sliding contact with the supply roller is formed of a material which is positioned on a side of the second polarity on a triboelectric series relative to the supply roller.

18 Claims, 12 Drawing Sheets

DEVELOPER UNIT, PROCESS DEVICE AND IMAGE FORMING APPARATUS

CROSS-REFERENCE TO RELATED APPLICATIONS

This application is based upon and claims the benefit of priority from Japanese Patent Application No. 2007-173533, filed on Jun. 29, 2007, the entire contents of which are incorporated herein by reference.

TECHNICAL FIELD

One aspect of the present invention relates to a developer unit, a process device and an image forming apparatus.

BACKGROUND

A developer device (developer unit) capable of accommodating a developer therein is disposed in an electrophotographic type image forming apparatus such as a laser printer or a digital multi function device. Then, the developer accommodated in the developer device is supplied to a developing roller through a supply roller and is further supplied from the developing roller to an image carrier on which an electrostatic latent image is formed, and thereafter is transferred to a recording sheet.

Since a developer is generally a consumable article, it is necessary to replace a developer cartridge detachable from the developer device body or directly supply a new developer to the inside of the developer device after the developer is used up.

When the new developer is supplied, a deteriorated developer remaining in the developer device is mixed with the new developer in the developer device. At this time, an electric charge moves between the new developer and the deteriorating developer, and the new developer is charged in a polarity to be properly charged, and the deteriorated developer is charged in a polarity opposite to the polarity to be properly charged. Consequently, the new developer and the deteriorating developer aggregate electrostatically and an aggregate is generated. When this aggregate or the oppositely charged developer (developer charged in the polarity opposite to the polarity to be properly charged) is supplied from the supply roller to the image carrier through the developing roller, for example, the developer is transferred to the portion other than an image to be formed, and image quality may reduce.

JP-A-8-202143 discloses a developer device including a conductive developing chamber and a supply roller made of a foamable material, and a bottom portion of the conductive developing chamber is arranged to opposite to the supply roller with an interval of, for example, 1 mm. A bias applied to the bottom portion of the developing chamber is a bias that deviates to the same polarity side as a charging polarity of a developer than a bias applied to the supply roller. In the developer device, an oppositely charged developer adhering to the supply roller is absorbed to the bottom portion of the developing chamber. As a result, electrostatic aggregation of the developer is suppressed, and an influence on image forming is suppressed.

In the developer device described above, the oppositely charged developer present between the bottom portion of developing chamber and a peripheral surface of the supply roller can be adsorbed. However, the oppositely charged developer in the vicinity of a region which is not opposite to the bottom portion of the developing chamber among the peripheral surface of the supply roller cannot be removed sufficiently. That is, a concentration of the oppositely charged developer present on the peripheral surface of the supply roller used in image formation cannot be decreased evenly in a circumferential direction of the supply roller. Therefore, quality of image cannot be ensured sufficiently.

SUMMARY

An object of one aspect of the invention is to provide a developer unit, a process device and an image forming apparatus capable of more improving image quality by evenly decreasing a concentration of an oppositely charged developer adhering to a peripheral surface of a supply roller in a circumferential direction of the supply roller.

According to a first aspect of the invention, there is provided a developer unit comprising: a developer accommodation member configured to accommodate a developer, the developer having charging polarity to a first polarity that is opposite to a second polarity; a developing roller arranged at the developer accommodation member, the developing roller being configured to carry the developer; a supply roller arranged at the developer accommodation member, the supply roller being configured to supply the developer to the developing roller, an image formation width being defined on a surface of the supply roller along an axis direction of the supply roller; and a charging member brought into sliding contact with an outside of the image formation width of the supply roller, wherein the charging member at a portion brought into sliding contact with the supply roller is formed of a material which is positioned on a side of the second polarity on a triboelectric series relative to the supply roller.

According to a second aspect of the invention, there is provided a process device comprising: a developer unit, wherein the developer unit comprising: a developer accommodation member configured to accommodate a developer, the developer having charging polarity to a first polarity that is opposite to a second polarity; a developing roller arranged at the developer accommodation member, the developing roller being configured to carry the developer; a supply roller arranged at the developer accommodation member, the supply roller being configured to supply the developer to the developing roller, an image formation width being defined on a surface of the supply roller along an axis direction of the supply roller; and a charging member brought into sliding contact with an outside of the image formation width of the supply roller, wherein the charging member at a portion brought into sliding contact with the supply roller is formed of a material which is positioned on a side of the second polarity on a triboelectric series relative to the supply roller; and an image carrier on which the developer is supplied from the developer unit and a developer image is formed.

According to a third aspect of the invention, there is provided an image forming apparatus capable of forming an image on a recording sheet, the image forming apparatus comprising: a process device comprising a developer unit and an image carrier on which a developer is supplied from the developer unit and a developer image is formed, the developer unit comprising: a developer accommodation member configured to accommodate a developer, the developer having charging polarity to a first polarity that is opposite to a second polarity; a developing roller arranged at the developer accommodation member, the developing roller being configured to carry the developer; a supply roller arranged at the developer accommodation member, the supply roller being configured to supply the developer to the developing roller, an image formation width being defined on a surface of the supply roller along an axis direction of the supply roller; and a charging member brought into sliding contact with an outside of the image formation width of the supply roller, wherein the charging member at a portion brought into sliding contact with the supply roller is formed of a material which is positioned on a side of the second polarity on a triboelectric series relative to the supply roller; an exposure device configured to expose the image carrier of the process device and form an electrostatic latent image on the image carrier; a transfer device configured to transfer a developer image formed by the process device to the recording sheet; and a fixing device configured to fix an image formed on the recording sheet.

BRIEF DESCRIPTION OF THE DRAWINGS

FIG. 11A is a print result of the first sheet of the printing, FIG. 11B is a print result of the fifth sheet of the printing, and FIG. 11C is a print result of the tenth sheet of the printing; FIG. 12A is a print result of the first sheet of the printing, FIG. 12B is a print result of the fifth sheet of the printing, and FIG. 12C is a print result of the tenth sheet of the printing.

DESCRIPTION (First Embodiment)

Figure 1:
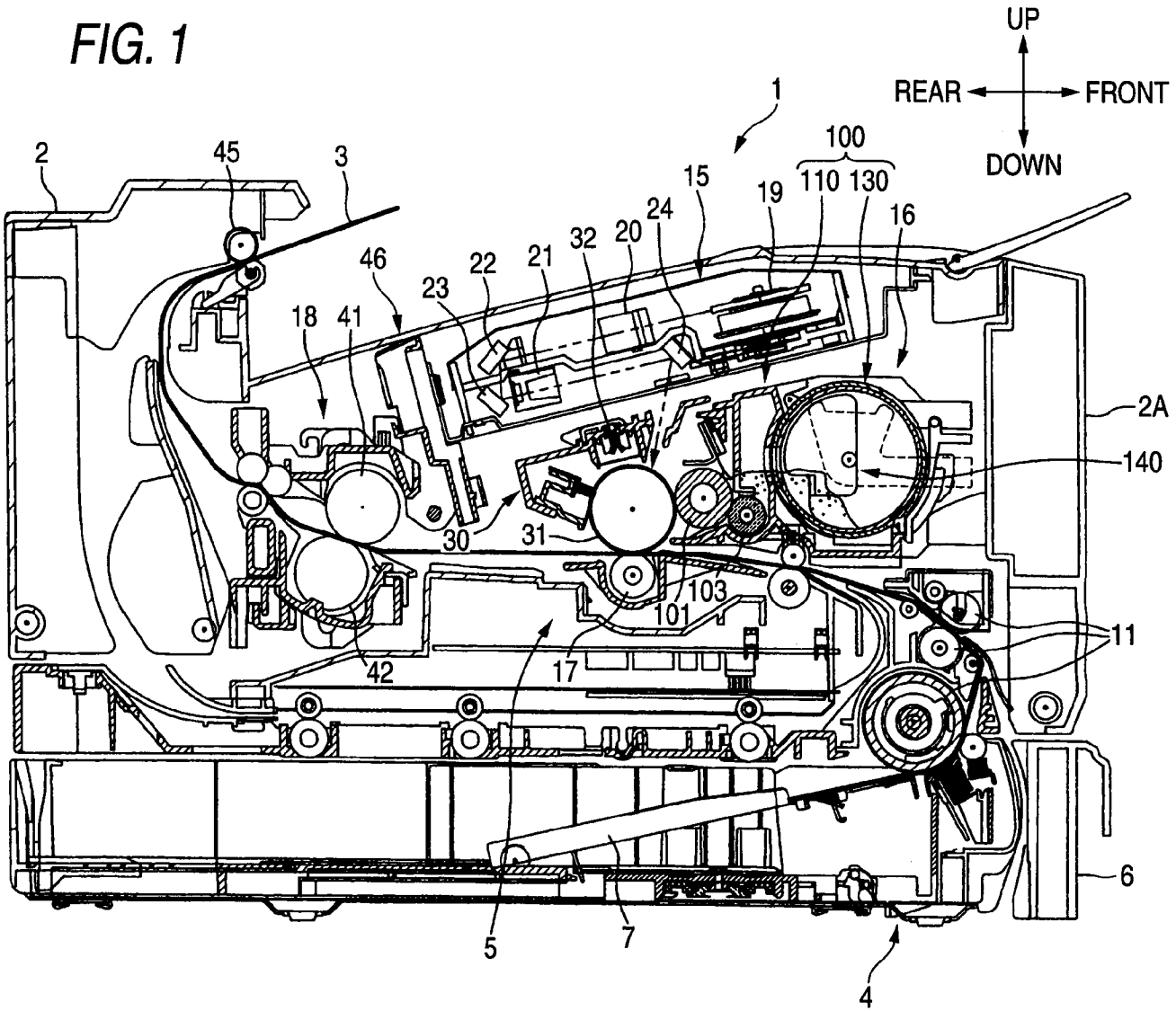
FIG. 1 is a side cross-sectional view showing a laser printer as one example of an image forming apparatus according to a first embodiment of the invention.
Figure 2:
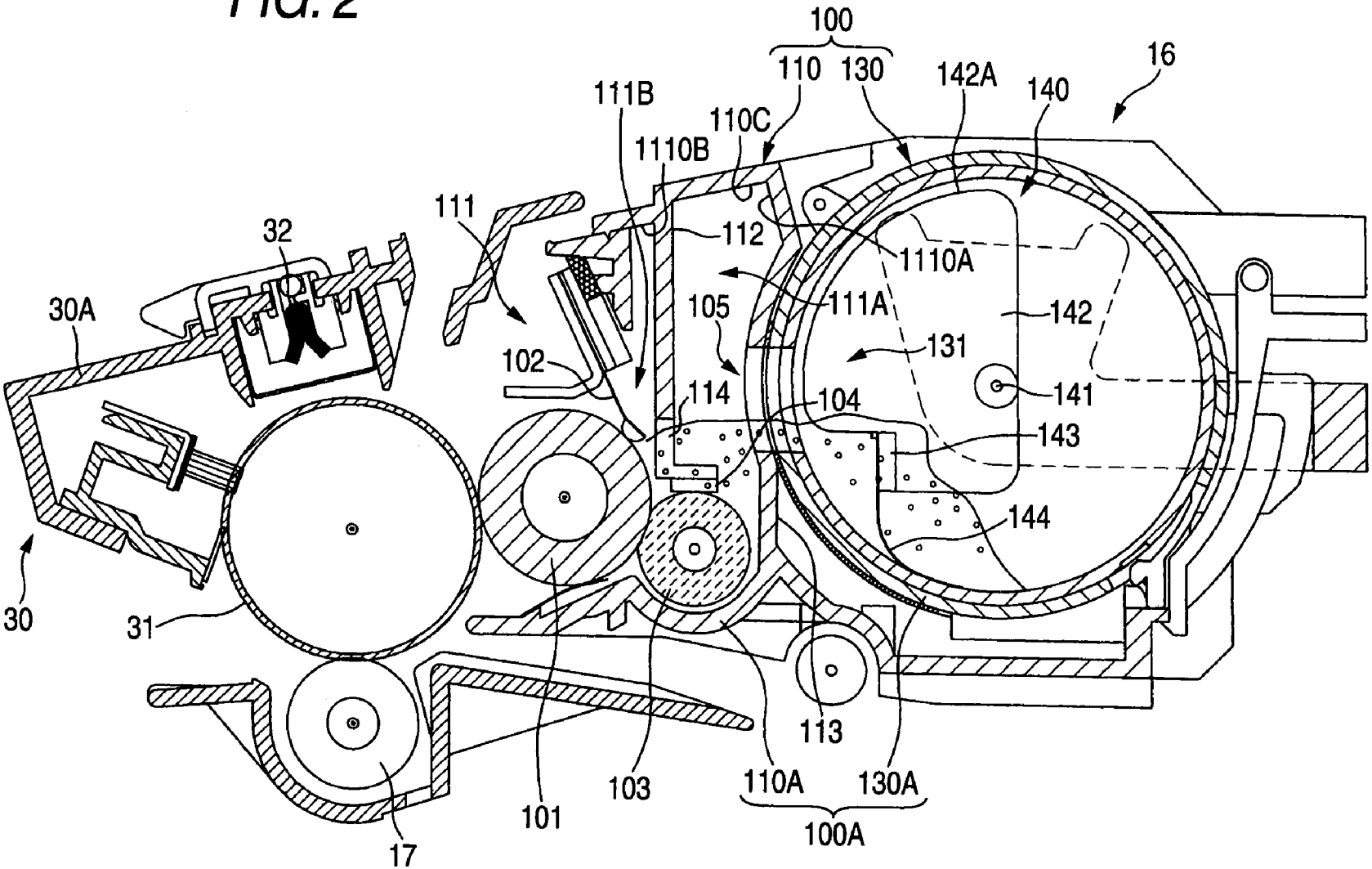
FIG. 2 is a side cross-sectional view showing a process device according to the first embodiment of the invention.
Figure 3:
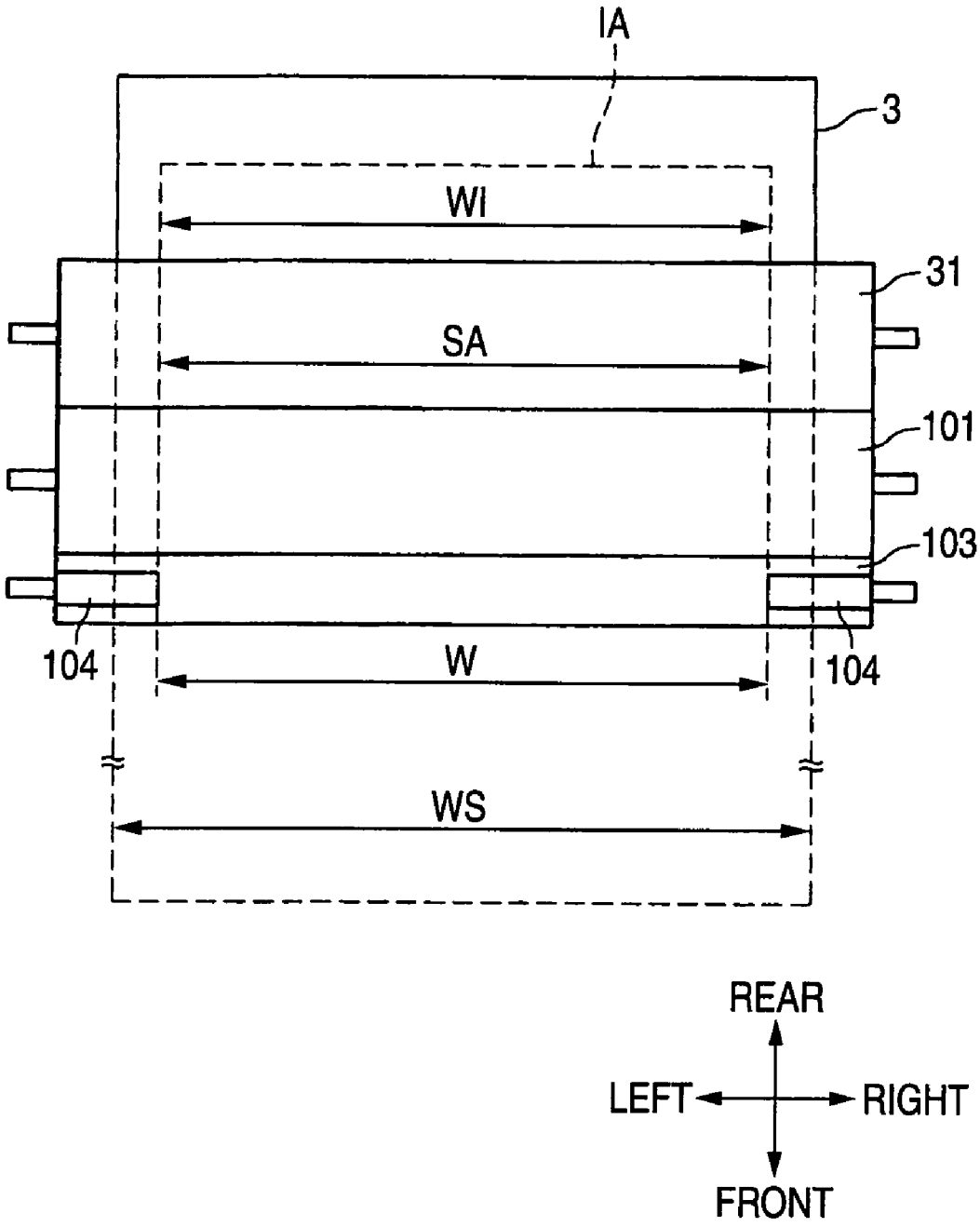
FIG. 3 is a schematic view describing an image formation width of a supply roller.

Next, a first embodiment of the invention will be described in detail with reference to the drawings. In the reference drawings, FIG. 1 is a side cross-sectional view showing a laser printer as one example of an image forming apparatus, and FIG. 2 is a side cross-sectional view showing a process device. Also, FIG. 3 is a schematic view describing an image formation width of a supply roller. In addition, in the following description, directions are described with reference to a user at the time of using the laser printer. That is, in FIG. 1, the right side of a paper surface is referred to as the "front side," the left side is referred to as the "rear side," the rear side of a vertical direction of the paper surface is referred to as the "right side," and the front side is referred to as the "left side". In addition, upper and lower directions are referred to as "upper and lower directions" since directions of the user at the time of using the laser printer match with the illustrated directions.

<The Whole Configuration of Laser Printer>

As shown in FIG. 1, a laser printer 1 as one example of an image forming apparatus includes a feeder 4 configured to feed a sheet 3 as one example of a recording sheet, and an image forming unit 5 configured to form an image on the sheet 3, which are disposed in a body casing 2.

<Configuration of Feeder>

The feeder 4 mainly includes a sheet feeding tray 6 detachably attached to a bottom portion of the inside of the body casing 2, and a sheet press plate 7 disposed in the sheet feeding tray 6. Also, the feeder 4 includes various rollers 11 configured to perform sheet powder removal or transport of the sheet 3.

In the feeder 4, the sheet 3 in the sheet feeding tray 6 is pulled upward by the sheet press plate 7 and is conveyed to the image forming unit 5 by various rollers 11.

<Configuration of Image Forming Unit>

The image forming unit 5 includes a scanner unit 15 as one example of an exposure device, a process device 16, a fixing unit 18 as one example of a fixing device.

<Configuration of Scanner Unit>

The scanner unit 15 is disposed in an upper portion of the body casing 2, and includes a laser light emitting unit (not shown), a polygon mirror 19 capable of being rotation driven, lenses 20, 21, reflecting mirrors 22, 23, 24. As shown by a chain line, a laser beam based on image data emitted from the laser light emitting unit is reflected or passed in order of the polygon mirror 19, the lens 20, the reflecting mirror 22, the reflecting mirror 23, the lens 21 and the reflecting mirror 24, and a surface of a photoconductive drum 31 as one example of an image carrier of the process device 16 is irradiated with the laser beam by high-speed scanning.

<Configuration of Process Device>

The process device 16 is detachably attached to the body casing 2 by opening a front cover 2A disposed on the front side of the body casing 2. This process device 16 is mainly includes a developer unit 100 and a drum unit 30.

The developer unit 100 is detachably attached to the body casing 2 through the drum unit 30, more specifically, is detachably attached to the drum unit 30 fixed inside the body casing 2. When the developer unit 100 is attached to the body casing 2, only the developer unit 100 may be attached to the body casing 2, or the process device 16 in which the drum unit 30 is attached to the developer unit 100 may be attached to the body casing 2.

The developer unit 100 includes a developing cartridge 110 and a toner cartridge 130.

As shown in FIG. 2, the developing cartridge 110 mainly includes: a developing case 110A that defines a developing chamber 111; a developing roller 101; a layer thickness regulating blade 102; a supply roller 103 that is brought into sliding contact with the developing roller 101; and a charging member 104 that is brought into sliding contact with the outside of an image formation width W (see FIG. 3) of the supply roller 103. The developing roller 101 and the supply roller 103 are positively biased at the time of development.

Here, as shown in FIG. 3, the "image formation width W" refers to the portion corresponding to a width WI along right and left directions of an image formation region IA on the sheet 3 in which the width is maximum in the sheet used in the laser printer 1, of the whole width of an axis direction (right and left directions) of the supply roller 103. In addition, the width WI along the right and left directions of the image formation region IA is equal to a laser beam scanning range SA of the surface of the photoconductive drum 31, so that the image formation width W is also equal to the laser beam scanning range SA of the surface of the photoconductive drum 31.

Figure 5:
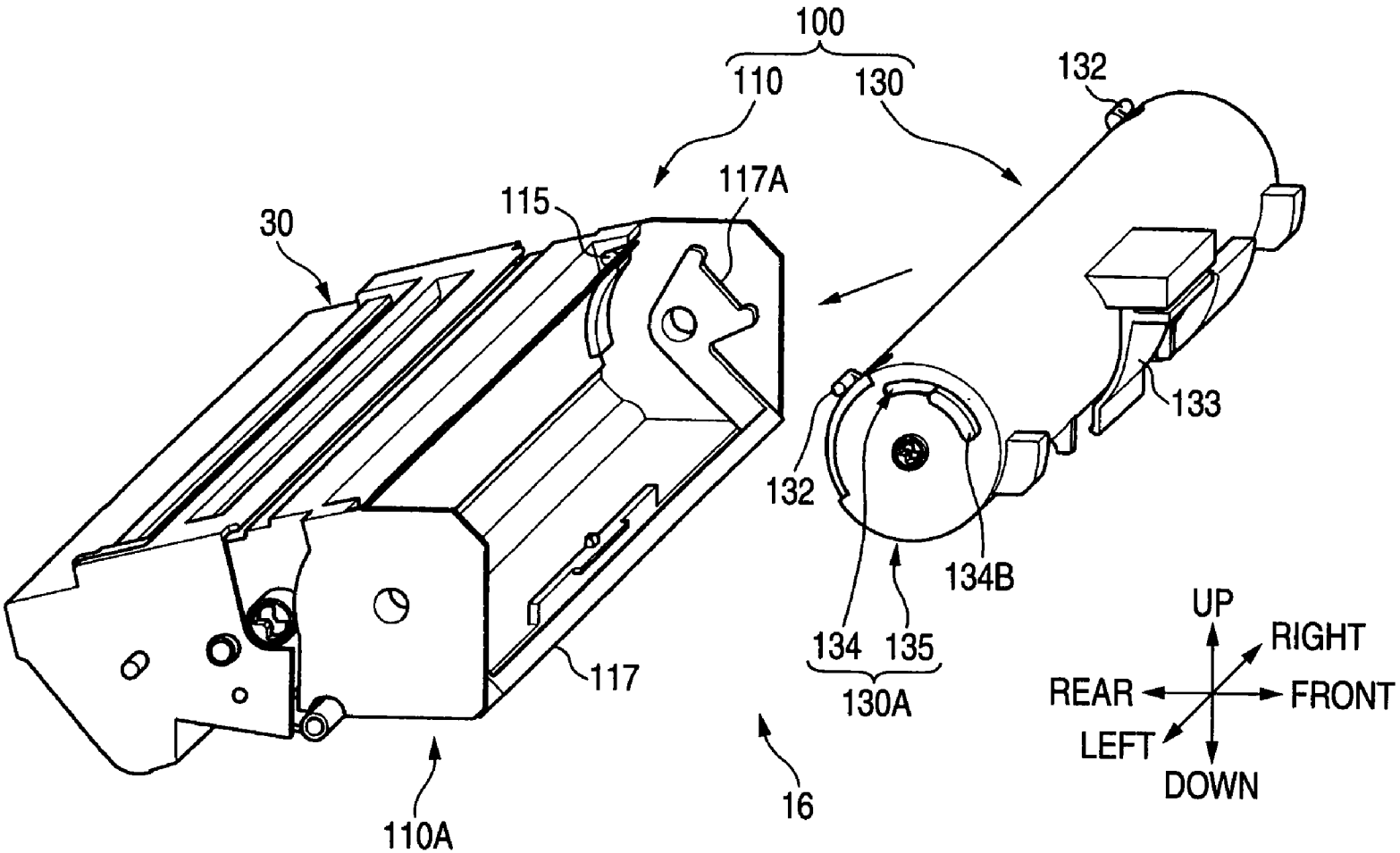
FIG. 5 is a perspective view showing a developing cartridge and a toner cartridge.

As shown in FIG. 2, the toner cartridge 130 includes a toner case 130A as one example of a developer case which defines a developer accommodation chamber 131, and is detachable from the developing case 110A (see FIG. 5). The developer accommodation chamber 131 is, more concretely, space and is defined by a wall surface (inner wall surface) of the toner cartridge 130.

In the embodiment, a developer accommodation member 100A, which is configured as a casing of the developer unit 100, includes the developing case 110A and the toner case 130A. Then, the developer accommodation member 100A with the toner case 130A attached to the developing case 110A can be attached to and detached from the body casing 2.

Toner as one example of a developer accommodated in the developer accommodation chamber 131 is agitated and transported by an agitator 140 as one example of developer transport member and is supplied to the inside of the developing chamber 111 through an opening 105 and thereafter is supplied to the developing roller 101 directly or through the supply roller 103. With rotation of the developing roller 101, the toner supplied to the developing roller 101 enters between the layer thickness regulating blade 102 and the developing roller 101 and is carried on the developing roller 101 as a thin layer with a predetermined thickness. At this time, the toner is positively charged by friction due to the sliding contact between the supply roller 103 and the developing roller 101 or the sliding contact between the layer thickness regulating blade 102 and the developing roller 101.

As shown in FIG. 2, the drum unit 30 mainly includes the photoconductive drum 31 as one example of the image carrier, a scorotron charging device 32, and a transfer roller 17 as one example of a transfer device.

The photoconductive drum 31 is rotatably supported in a drum case 30A and is arranged to be brought into contact with the developing roller 101 in the rear side of the developing roller 101 in a state where the developer unit 100 is attached to the drum unit 30.

The scorotron charging device 32 is a scorotron type charging device for positive charging configured to generate a corona discharge from a wire for charging such as tungsten, and is configured to uniformly charge a surface of the photoconductive drum 31 in positive polarity.

The transfer roller 17 is rotatably supported in the drum case 30A and is arranged under the photoconductive drum 31 to oppose to and contact with the photoconductive drum 31. A transfer bias is applied to this transfer roller 17 by constant-current control at the time of transfer.

In the process device 16, the surface of the photoconductive drum 31 is positively charged uniformly by the scorotron charging device 32 and thereafter is exposed by high-speed scanning of a laser beam from the scanner unit 15. Consequently, a potential of the exposed portion falls and an electrostatic latent image based on image data is formed.

Here, the "electrostatic latent image" refers to the exposed portion which is a portion of the surface of the photoconductive drum 31 being uniformly and positively charged, but potential of the exposed portion falls due to exposure by the laser beam.

Then, by rotation of the developing roller 101, the toner carried on the developing roller 101 is supplied to the electrostatic latent image formed on the surface of the photoconductive drum 31 when the toner is opposed to and is brought into contact with the photoconductive drum 31. Thus, the toner is selectively carried on the surface of the photoconductive drum 31 to allow a visible image to be obtained, and a toner image is formed by reversal development.

Thereafter, the photoconductive drum 31 and the transfer roller 17 are rotated and driven such that the sheet 3 is conveyed in a state where the sheet 3 is pinched between the photoconductive drum 31 and the transfer roller 17, and thereby the toner image carried on the surface of the photoconductive drum 31 is transferred to the sheet 3.

<Configuration of Fixing Unit>

As shown in FIG. 1, the fixing unit 18 is disposed on the downstream side of the process device 16, and mainly includes a heating roller 41, and a press roller 42 which is arranged to oppose to the heating roller 41 and presses the heating roller 41.

In the fixing unit 18, the toner transferred to the sheet 3 is thermally fixed while the sheet 3 passes between the heating roller 41 and the press roller 42. The sheet 3 on which the toner is thermally fixed in the fixing unit 18 is conveyed by a sheet delivery roller 45 disposed on the downstream side of the fixing unit 18 and is delivered to a sheet delivery tray 46.

<Detailed Structure of Developer Unit>

Figure 4:
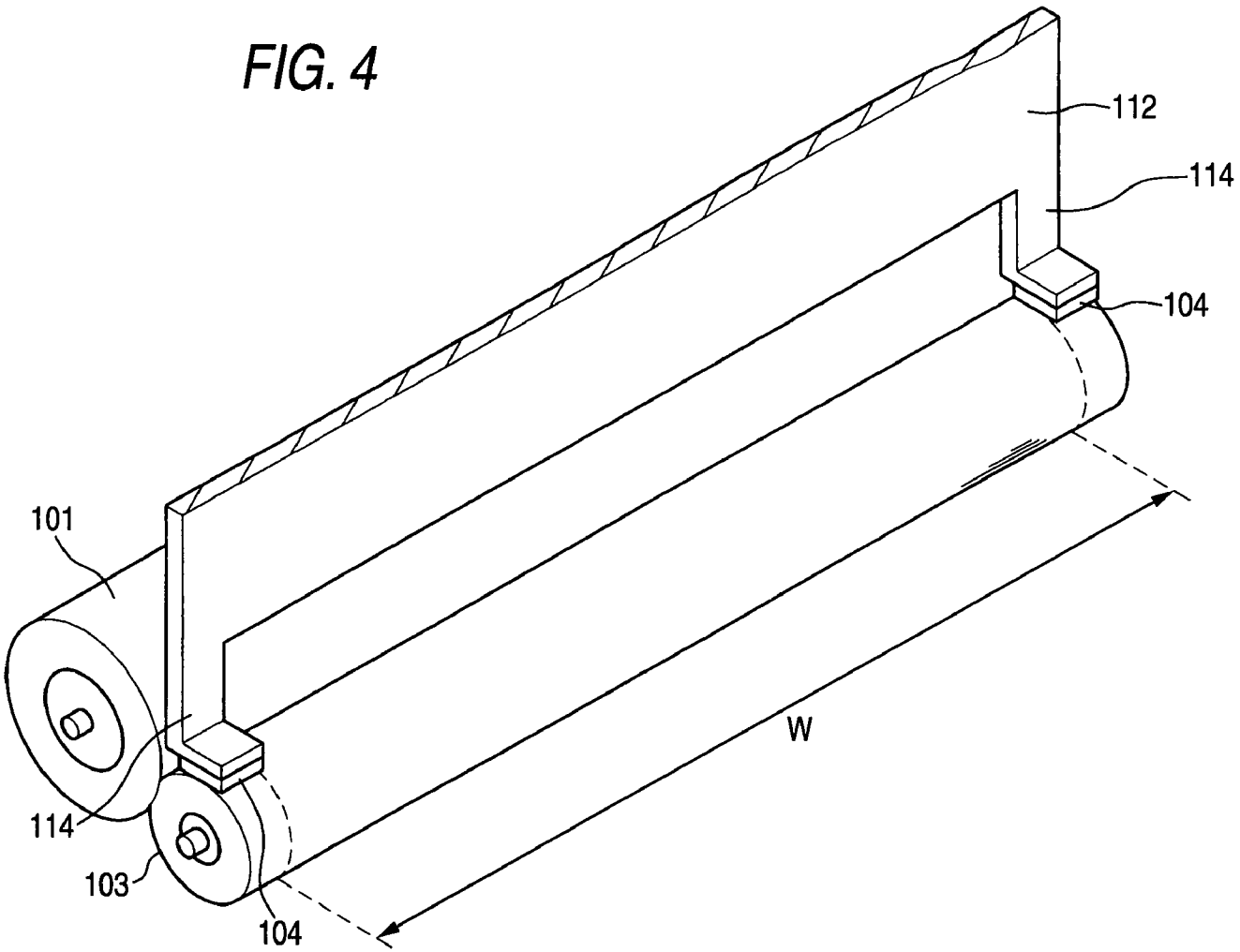
FIG. 4 is a perspective view showing an arrangement position of a charging member with respect to the supply roller.
Figure 6A:
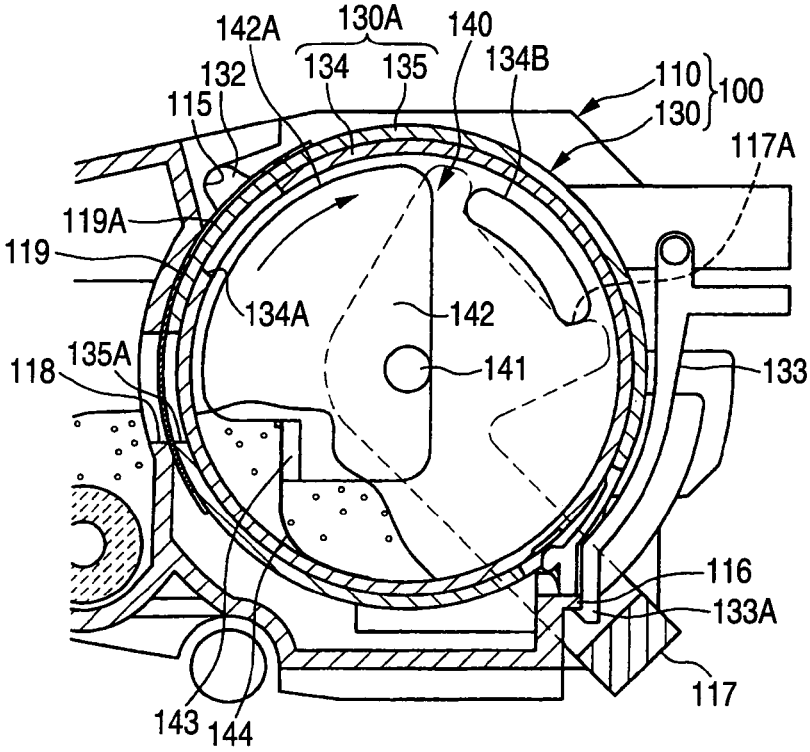
FIG. 6A is a side cross-sectional view showing a state of attaching the toner cartridge to the developing cartridge and FIG. 6B is a side cross-sectional view showing a state in which a developing chamber communicates to a developer accommodation chamber.
Figure 6B:
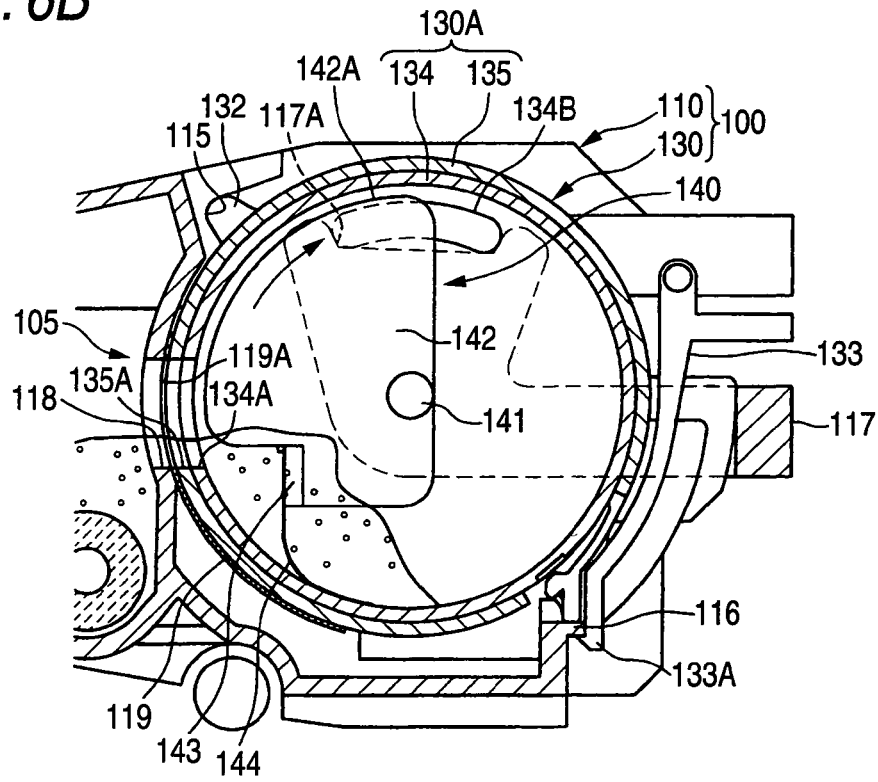
Figure 7A:
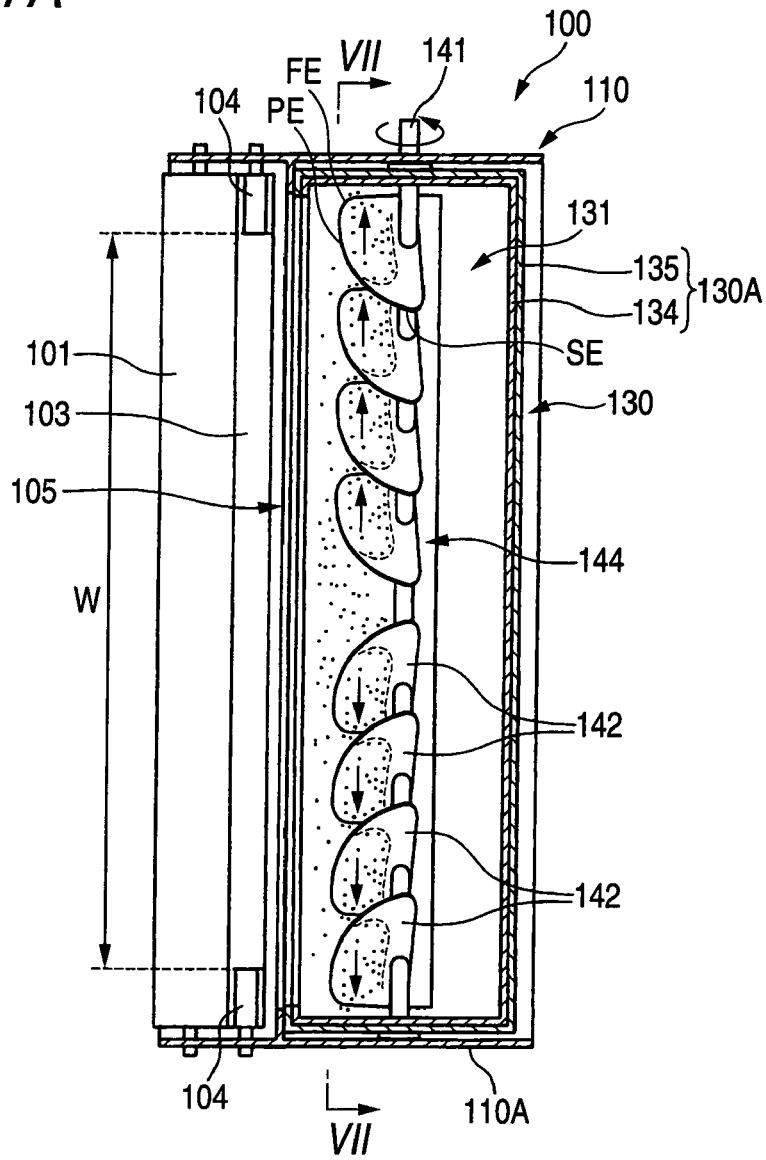
FIG. 7A is a cross-sectional view showing a flow of toner in the state of FIG. 6B and a formation range of an opening and FIG. 7B is a cross-sectional view taken on line VII-VII of FIG. 7A.
Figure 7B:
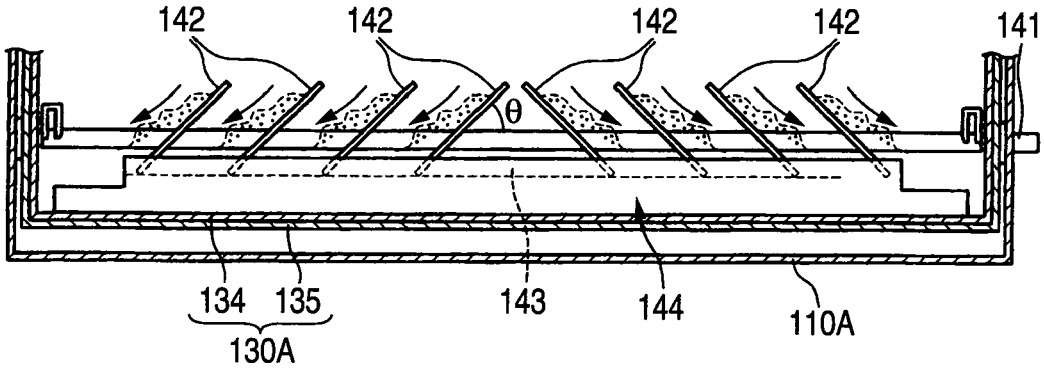

Next, a detailed structure of the developer unit 100 according to the first embodiment of the invention will be described. FIG. 4 is a perspective view showing an arrangement position of a charging member with respect to a supply roller, and FIG. 5 is a perspective view showing a developing cartridge and a toner cartridge. Also, FIG. 6A is a side cross-sectional view showing a state of attaching the toner cartridge to the developing cartridge, and FIG. 6B is a side cross-sectional view showing a state in which a developing chamber communicates with a developer accommodation chamber. Further, FIG. 7A is a cross-sectional view showing a flow of toner in the state of FIG. 2 and a formation range of an opening, and FIG. 7B is a cross-sectional view taken on line VII-VII of FIG. 7A.

As described above, the developer accommodation member 100A as the casing of the developer unit 100 is formed by the developing case 110A and the toner case 130A.

As shown in FIG. 2, the developing case 110A rotatably supports the developing roller 101 and the supply roller 103 and also, defines the developing chamber 111 in which the developing roller 101, the layer thickness regulating blade 102, the supply roller 103 and the charging member 104 are arranged.

A partition wall 112 is provided at the inside of an upper wall of the developing case 110A and positioned above the supply roller 103. The partition wall 112 extends from an upper portion toward a lower portion and is arranged so as to divide the developing chamber 111 into two portions. For convenience of description, the front side, that is, one portion, of the two portions of the developing chamber 111 divided by the partition wall 112, in which toner is accumulated is called a first developing chamber 111A, and the rear side, that is, the other portion in which the developing roller 101 and the layer thickness regulating blade 102 are arranged is called a second developing chamber 111B.

More concretely, the first developing chamber 111A is space and is defined by a wall surface (inner wall surface) 1110A of the developing case 110A. Also, the second developing chamber 111B is space and is defined by a wall surface (inner wall surface) 1110B of the developing case 110A.

A demarcation wall 113 as one example of a demarcation portion that is a part of the developing case 110A and also demarcates the developing chamber 111 from the toner case 130A (developer accommodation chamber 131) described below is formed in the front side of the developing case 110A.

As shown in FIG. 4, the charging members 104 are respectively disposed so as to be brought into sliding contact with the supply roller 103 on both end portions of the supply roller 103, more specifically, on the outside of the image formation width W. The charging members 104 are fixed by fixing members 114 respectively formed at lower portions of both end portions of the partition wall 112.

A surface of the supply roller 103 of the embodiment is formed of a urethane foamed elastic body. On the other hand, the charging member 104 is formed of an ABS resin plate which is a material positioned to the negative polarity side than the surface material of the supply roller 103, that is, urethane, on a triboelectric series. Consequently, when the supply roller 103 rotates and is brought into sliding contact with the charging members 104, a portion of the supply roller 103 which is brought into sliding contact with the charging members 104 is positively charged by friction. The charging member 104 may be formed of, for example, a Teflon (registered trademark) resin or a vinyl chloride resin in addition to the ABS resin.

Here, the "triboelectric series" refers to sequence in which when friction (sliding contact) between two kinds of materials is produced, the material having a tendency to be charged to the positive polarity side is arranged to the high-order side (positive polarity side) and the material having a tendency to be charged to the negative polarity side is arranged to the low-order side (negative polarity side).

As shown in FIG. 2, the toner case 130A forms the developer accommodation chamber 131 in which toner is accommodated, and the developer accommodation chamber 131 communicates with the first developing chamber 111A (developing chamber 111) through the opening 105. Also, the toner case 130A rotatably supports the agitator 140 configured to agitate toner of the inside of the developer accommodation chamber 131 and also transport the toner toward the outside of the image formation width W of the supply roller 103. Further, the toner case 130A is detachable from the developing case 110A as described above, so that toner supply can be facilitated and handling of the developer unit 100 is facilitated.

One example of an attachment and detachment mechanism of the developing case 110A (developing cartridge 110) and the toner case 130A (toner cartridge 130) will herein be described.

When the toner case 130A is attached to the developing case 110A, the toner case 130A is pushed toward the front side portion of the developing case 110A while positioning pins 132 of the toner case 130A are aligned with positioning recess portions 115 of the developing case 110A as shown in FIG. 5. At this time, the toner case 130A is fixed to the developing case 110A by hooking an engaging claw 133A of a lever 133 for fixing of the toner case 130A to an engaged portion 116 of the developing case 110A as shown in FIG. 6A. Also, when the toner case 130A is detached from the developing case 110A, the engaging claw 133A is unhooked by pulling up the lever 133 for fixing and the toner case 130A is pulled to an oblique upper portion of the front side of the developing case 110A.

Here, the toner case 130A includes a cylindrical inside casing 134 and an outside casing 135 that rotatably supports the inside casing 134. An inside opening 134A is formed at the inside casing 134, and an outside opening 135A is formed at the outside casing 135, respectively, as shown in FIG. 6A. In a state where the toner case 130A is in a single state (that is, the toner cartridge 130) or a state where the toner case 130A is merely fixed to the developing case 110A (see FIG. 6A), the inside opening 134A does not communicate with the outside opening 135A.

When the toner case 130A is fixed to the developing case 110A, circular arc protrusions 134B (see FIG. 5) formed on both ends of the inside casing 134 fit into recess portions 117A of operation levers 117 swingably disposed in the developing case 110A as shown in FIG. 6A. Then, communication between the inside opening 134A and the outside opening 135A is allowed by upward swinging the operation levers 117 and turning the inside casing 134 with respect to the outside casing 135 as shown in FIG. 6B.

A shutter 119 configured to open and close a toner supply port 118 disposed in the developing case 110A is provided so as to turn integrally with the inside casing 134 by engaging with an engaging portion (not shown) of the inside casing 134 simultaneously at this time. Consequently, by upward swinging the operation lever 117, communication among the toner supply port 118, a shutter opening 119A, the outside opening 135A and the inside opening 134A is allowed, and the opening 105 is formed.

In addition, the front side of the toner case 130A is also fixed by this operation lever 117 in a state shown in FIG. 6B.

As shown in FIG. 7A, the opening 105 is formed over substantially the whole width (whole width of a roller portion) of an axis direction of the supply roller 103 and is configured so that toner can mutually exchange between the first developing chamber 111A and the developer accommodation chamber 131 (see FIG. 2). The opening 105 is formed such that both the end portions of right and left directions of the opening 105 extends over a range wider than the image formation width W of the supply roller 103, that is, the opening 105 reaches a range of the outside of the image formation width W in the axis direction of the supply roller 103.

Next, the agitator 140 will be described. As shown in FIGS. 2 and 7A and 7B, the agitator 140 is a member configured to agitate toner in the developer accommodation chamber 131 and also transport the toner to the first developing chamber 111A through the opening 105. This agitator 140 includes a rotational support shaft 141, vanes 142, a joint portion 143 and a flexible sheet member 144.

The rotational support shaft 141 extends along right and left directions of the developer accommodation chamber 131, and both ends of the rotational support shaft 141 are rotatably supported on side walls of the toner case 130A. By applying rotational driving force from a motor (not shown) to the rotational support shaft 141, the agitator 140 rotates in the developer accommodation chamber 131 and agitates and transports the toner.

Each of the vanes 142 is a plate-shaped member having sufficient rigidity for agitating and transporting toner, and plural vanes are fixed to the rotational support shaft 141. As shown in FIG. 7A, each of the vanes 142 has a peripheral edge PE extending from a first end FE to a second end SE, and the first end FE is positioned upstream the second end SE with respect to the rotation direction of the rotational support shaft 141. As shown in FIG. 7B, a direction of a plate surface of the vane 142 is inclined so that the side near to the rotational support shaft 141 is close to the outside of the developer accommodation chamber 131 and the far side is close to the center of the developer accommodation chamber 131 (rotational support shaft 141). In other words, the second end SE is positioned nearer a center of the rotational support shaft 141 with respect to the axis direction than the first end. An angle θ of the vane 142 with respect to the rotational support shaft 141 is desirably about 40 to 60°, more desirably about 45°. Such vanes 142 are disposed over the width corresponding to a formation range of the opening 105.

The joint portion 143 is a reed-shaped member mounted along an axis direction of the rotational support shaft 141, and mutually joins lower portions of each of the vanes 142. Also, in the joint portion 143, the flexible sheet member 144 is pasted on a surface opposite to a surface connected to the vanes 142.

The flexible sheet member 144 is configured to transport toner accumulated in a bottom portion of the developer accommodation chamber 131 toward the first developing chamber 111A while scraping the toner, and is formed of a sheet etc. made of resin having flexibility, for example, polyethylene terephthalate (PET). The flexible sheet member 144 has a length (size of a direction perpendicular to the axis direction) such that, when the distal end of the flexible sheet member 144 faces to the first developing chamber 111A (opening 105), the flexure is restored and the sheet can fully stretches. Consequently, the toner can be transported to the first developing chamber 111A.

When the agitator 140 rotates in a clockwise direction (arrow direction of FIGS. 6A and 6B) as shown in FIGS. 6A and 6B, the distal end portions 142A (second ends SE) of the vanes 142 enter toner held in the bottom portion of the developer accommodation chamber 131 and scoop up the toner and push the toner to the first developing chamber 111A (opening 105). When the distal end portions 142A of the vanes 142 start to turn upward, the toner placed on the vanes 142 runs on surfaces of the vanes 142 and flows down in an outside direction (arrow direction of FIGS. 7A and 7B) of the developer accommodation chamber 131 and moves in the outside direction as shown in FIGS. 7A and 7B. When the agitator 140 further rotates, the flexure is restored and the sheet member 144 stretches when the flexible sheet member 144 faces to the first developing chamber 111A (opening 105), so that the toner is transported to the first developing chamber 111A.

At this time, the toner also moves and accumulates in the vicinities of both end portions in the right and left directions of the developer accommodation chamber 131 by the vanes 142, and is also transported and supplied to both end portions (outside of the image formation width W) of the supply roller 103 of the inside of the first developing chamber 111A through the opening 105 by the flexible sheet member 144. According to the agitator 140, the toner of the inside of the developer accommodation chamber 131 can be transported and supplied toward the outside of the image formation width W of the supply roller 103.

Figure 8:
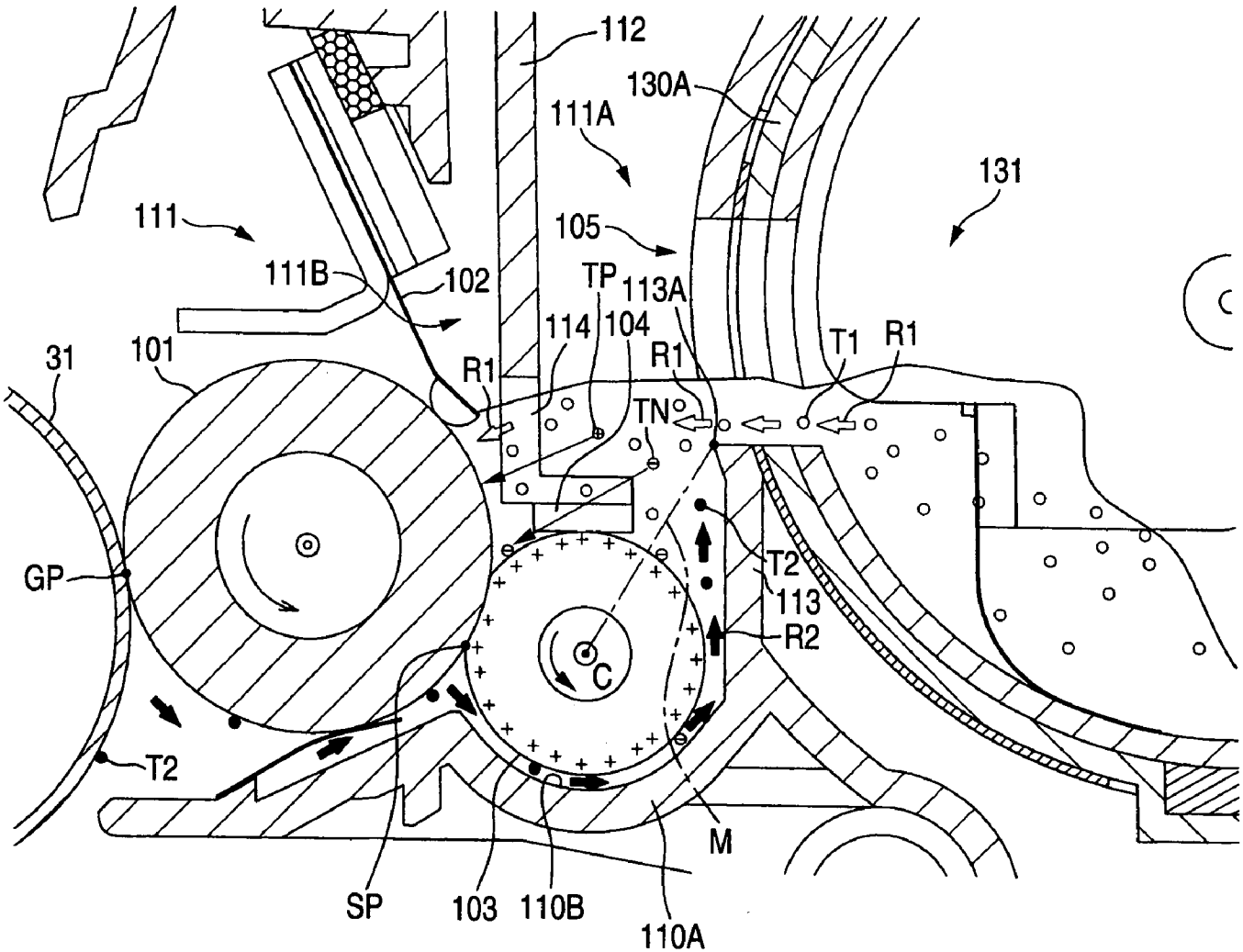
FIG. 8 is an enlarged cross-sectional view describing operation of a charging member.

Next, operation of the charging member 104 of the developer unit 100 as described above will be described. FIG. 8 is an enlarged cross-sectional view describing the operation of the charging member.

The developing case 110A has a first opposed wall 110B as shown in FIG. 8. The first opposed wall 110B is opposed to a region on a surface of the developing roller 101 extending from a development position GP and continued toward a down stream side of a rotation direction of the developing roller 101 to a position SP where the developing roller 101 contacts with the supply roller 103, and a region on a surface of the supply roller 103 extending from the position SP where the supply roller 103 contacts with the developing roller 101 and continued toward the downstream side of a rotation direction of the supply roller 103.

Here, the "development position GP" refers to a position on the surface of the developing roller 101 nearest to the photoconductive drum 31, and particularly in the embodiment, refers to a position on the surface of the developing roller 101 in contact with the photoconductive drum 31.

Also, the developing case 110A has a second opposed wall 110C (see FIG. 2) disposed on the opposite side of the first opposed wall 110B with respect to the supply roller 103.

The demarcation wall 113 described above continuously extends from the first opposed wall 110B toward the downstream side (toward the side of the second opposed wall 110C) of the rotational direction of the supply roller 103 and thereby, demarcates the developer accommodation chamber 131 from the first developing chamber 111A. More specifically, the demarcation wall 113 is formed between the developer accommodation chamber 131 and the first developing chamber 111A, and the upper end (top) of the demarcation wall 113 forms a part of the opening 105.

Here, a toner collection path R2 is defined in this embodiment to include: a path formed between the first opposed wall 110B and the developing roller 101 and the supply roller 103; and a path formed between the supply roller 103 and the demarcation wall 113. In the toner collection path R2, deteriorating toner T2 is collected from the photoconductive drum 31 to the inside of the first developing chamber 111A through the developing roller 101 and the supply roller 103.

Also, a toner supply path R1 is defined in this embodiment to include: a path in which new toner T1 moves from the developer accommodation chamber 131 to a merging portion M described below through the opening 105; and a path in which the toner T1 is supplied from the merging portion M through the developing roller 101 to the photoconductive drum 31. The toner supply path R1 is formed in the side opposite to the first opposed wall 110B with respect to the supply roller 103 in the downstream side from the merging portion M.

Further, the merging portion M in this embodiment is defined by a region between a surface of the supply roller 103 and a rear side upper end 113A on a line (plane) connecting the rotational center C of the supply roller 103 to the rear side upper end 113A of the demarcation wall 113, that is, a region in which the toner supply path R1 and the toner collection path R2 merge.

The toner of the embodiment is nonmagnetic without including magnetic particles, one-component, positively chargeable, and polymerization toner. Since the toner is brought into sliding contact between the supply roller 103 and the developing roller 101 or between the layer thickness regulating blade 102 and the developing roller 101 or between the developing roller 101 and the photoconductive drum 31 while the toner is frictionally charged and supplied from the supply roller 103 to the developing roller 101 and the photoconductive drum 31, the toner tends to deteriorate and becomes resistant to charge to the positive polarity side. Thus, the toner deteriorates and results in the deteriorating toner T2.

Since the deteriorating toner T2 is collected to the inside of the first developing chamber 111A through the toner collection path R2, the toner T2 remains inside the developing chamber 111. When the toner cartridge 130 is replaced in this state and then new toner T1 is supplied to the inside of the first developing chamber 111A through the toner supply path R1, the new toner T1 is mixed with the deteriorating toner T2 in the vicinity of the merging portion M. When the new toner T1 is mixed with the deteriorating toner T2, by friction of the mutual toners, the new toner T1 is positively charged and becomes positively charged toner TP, and the deteriorating toner T2 is negatively charged and becomes oppositely charged toner (toner charged in negative polarity opposite to positive polarity to be properly charged) TN.

The developing roller 101 and the supply roller 103 rotate and drive in the same direction (counterclockwise direction, arrow direction of FIG. 8) when image formation is started in a state where each of the toners T1, T2, TN, TP described above is present as shown in FIG. 8. Then, by rotation of the supply roller 103, a surface of the supply roller 103 formed of a urethane foamed elastic body is brought into sliding contact with the charging member 104 formed of an ABS resin plate, and a portion in which the supply roller 103 is brought into sliding contact with the charging member 104 is positively charged by friction.

Consequently, the oppositely charged toner TN remaining inside the first developing chamber 111A or the oppositely charged toner TN newly generated after the image formation is started is adsorbed to the sliding contact portion of the supply roller 103 positively charged by electrostatic force. By adsorbing the oppositely charged toner TN to the sliding contact portion of the supply roller 103, the oppositely charged toner TN is separated from the positively charged toner TP, so that occurrence of an aggregate is suppressed.

Also, the whole peripheral surface of the sliding contact portion of the supply roller 103 is positively charged by the charging member 104, so that the oppositely charged toner TN is adsorbed on the whole peripheral surface at the sliding contact portion which is positioned outside the image formation width W of the supply roller 103. Consequently, a concentration of the oppositely charged toner TN decreases evenly on the whole peripheral surface of the inside of the image formation width W of the supply roller 103 and occurrence of an aggregate is also suppressed on the whole peripheral surface of the inside of the image formation width W of the supply roller 103.

Also, the new toner T1 in the developer accommodation chamber 131 is supplied to a sliding contact portion with the charging member 104, which is outside of the image formation width W of the supply roller 103, through the opening 105 by the agitator 140. Consequently, the new toner T1 is mixed with the deteriorating toner T2 in the vicinity of the sliding contact portion of the supply roller 103 positively charged, so that the oppositely charged toner TN which is generated can be adsorbed effectively.

In addition, the positively charged toner TP is supplied to the developing roller 101 directly or through the supply roller 103 without being adsorbed to the charging member 104 positively charged and is further supplied from the developing roller 101 to the photoconductive drum 31 and thereafter is transferred to the sheet 3 and an image is formed.

According to the above, the following advantages can be obtained in aspects of the embodiment.

The supply roller 103 is brought into sliding contact with the charging member 104 and thereby, the whole peripheral surface of the sliding contact portion of the supply roller 103 is charged to the positive polarity side, so that the oppositely charged toner TN can be adsorbed on the whole peripheral surface of the sliding contact portion of the supply roller 103 and a concentration of the oppositely charged toner TN in the inside of the image formation width W of the supply roller 103 can be decreased evenly. Consequently, occurrence of an aggregate in the inside of the image formation width W of the supply roller 103 is suppressed, and a situation in which the oppositely charged toner TN or the aggregate is supplied from the supply roller 103 to the photoconductive drum 31 through the developing roller 101 is suppressed, so that image quality can be more improved.

Since the opening 105 is formed to a range of the outside of the image formation width W and also the agitator 140 transports the new toner T1 toward the outside of the image formation width W, the oppositely charged toner TN generated by mixing the new toner T1 with the deteriorating toner T2 can effectively be adsorbed to the charged portion of the supply roller 103. Consequently, a concentration of the deteriorating toner T2 present on a peripheral surface of the inside of the image formation width W of the supply roller 103 decreases relatively, and generation of the oppositely charged toner TN on the peripheral surface is suppressed, so that image quality can be more improved.

Since the surface of the supply roller 103 is formed of a foamed elastic body, many recess portions are formed on the surface of the supply roller. Because of this, toner is carried in the recess portions of the surface of the supply roller 103, and a surface portion other than the recess portions is elastically appropriately deformed and thereby, the supply roller 103 is surely brought into sliding contact with the charging member 104. Consequently, the supply roller 103 can surely transport the toner and make sliding contact with the charging member 104 to be charged to the positive polarity side.

Since the developing roller 101 and the supply roller 103 rotate in the same direction (counterclockwise direction), a toner supply path (not shown) from the supply roller 103 to the developing roller 101 is clearly distinguished from the toner collection path R2 from the developing roller 101 to the supply roller 103. Consequently, the deteriorating toner T2 or the oppositely charged toner TN smoothly flows through a developing chamber, so that retention of the deteriorating toner T2 or the oppositely charged toner TN can be suppressed and adsorption of the oppositely charged toner TN by the charging member 104 can be performed more effectively.

Also, the deteriorating toner T2 or the oppositely charged toner TN smoothly flows through the developing chamber, so that a situation in which the deteriorating toner T2 or the oppositely charged toner TN is locally retained is suppressed. As a result of that, a reduction in quality of a formed image due to an increase in a concentration of the deteriorating toner T2 or the oppositely charged toner TN is suppressed.

By arranging the charging member 104 in the downstream side of a rotation direction of the supply roller 103 from the merging portion M of the toner collection path R2 and the toner supply path R1, the oppositely charged toner TN can effectively be adsorbed in a position near to the developing roller 101. That is, at the supply roller 103, the whole peripheral surface of a sliding contact portion is positively charged by the charging member 104, but the amount of charge decreases as the supply roller 103 moves away from a sliding contact portion with the charging member 104, so that force of adsorbing the oppositely charged toner TN becomes strongest in a region just after the sliding contact portion on the peripheral surface of the supply roller 103. By arranging this region in the downstream side of the rotational direction from the merging portion M of the toner collection path R2 and the toner supply path R1, a region in which the oppositely charged toner TN is adsorbed most strongly can be arranged in the position near to the developing roller 101. Consequently, the oppositely charged toner TN can effectively be adsorbed in the position near to the developing roller 101 and the new toner T1 can effectively be supplied to the developing roller 101.

(Second Embodiment)

Next, a second embodiment of the invention will be described in detail with reference to the drawings. In the present embodiment, a configuration of a part of the developer unit 100 according to the first embodiment described above, specifically, an arrangement position of the charging member 104 is changed, so that only this respect is described. In the reference drawings, FIG. 9 is an enlarged cross-sectional view showing a main portion of a developer unit according to the embodiment, and FIG. 10 is a plan view showing a relation between a fixing member and a charging member and an arrangement position of the charging member with respect to a supply roller.

Figure 9:
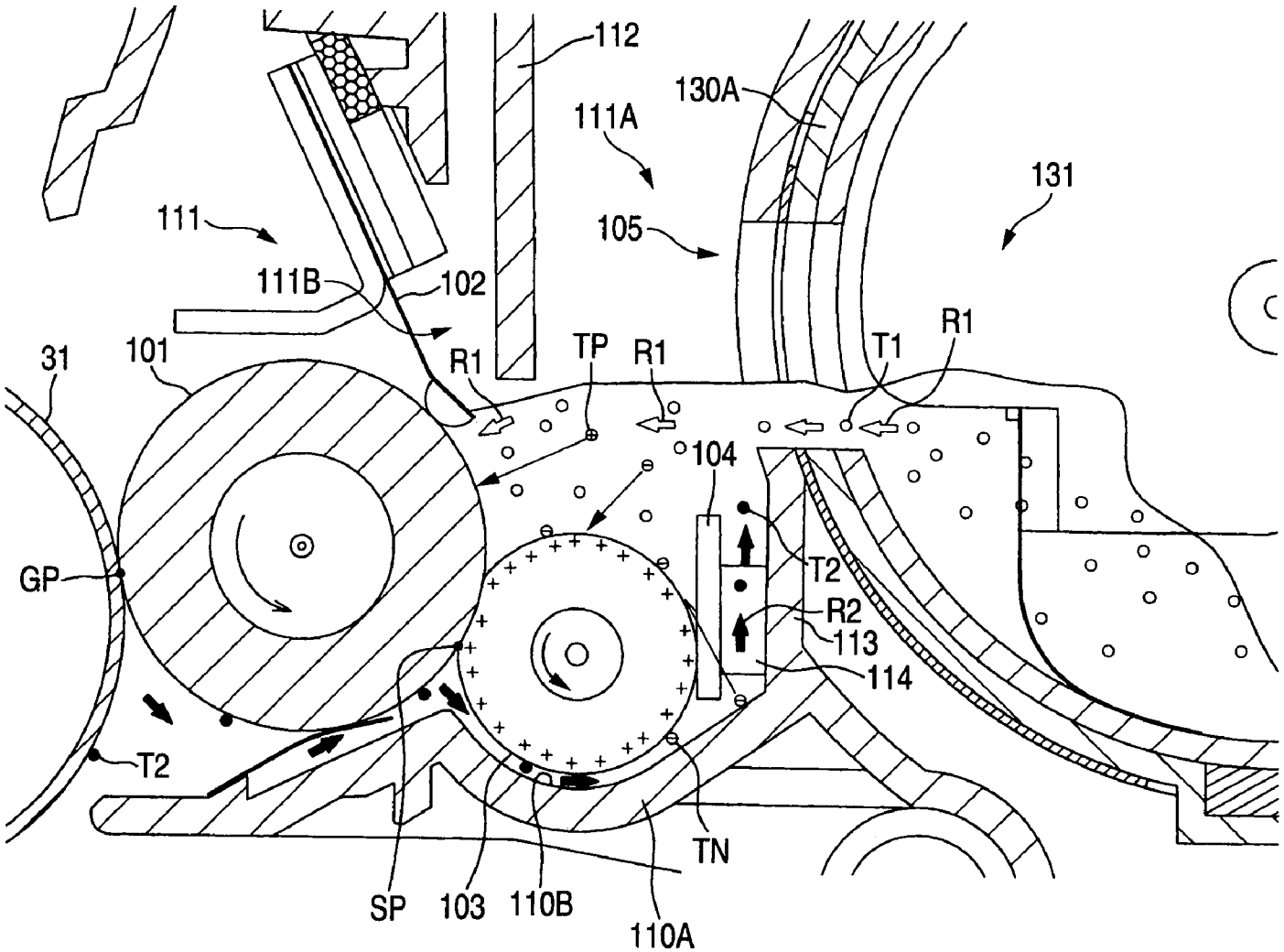
FIG. 9 is an enlarged cross-sectional view showing a main portion of a developer unit according to a second embodiment of the invention.
Figure 10:
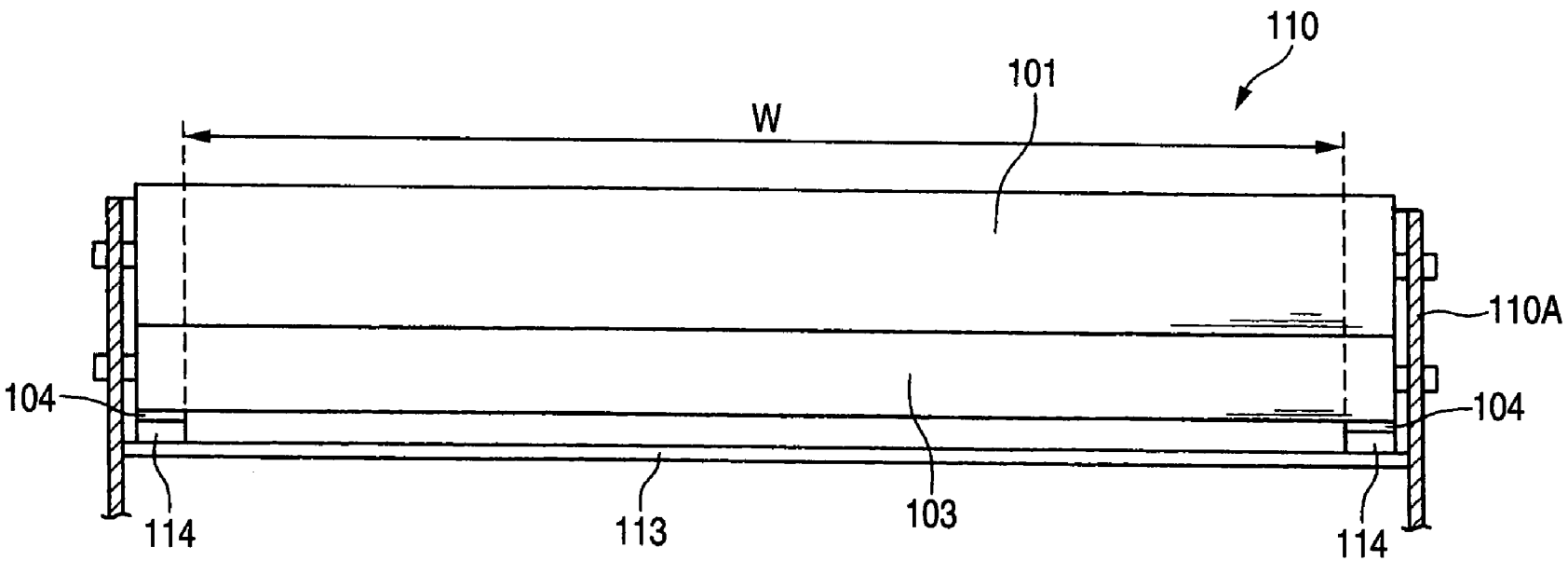
FIG. 10 is a plan view showing a relation between a fixing member and a charging member and an arrangement position of the charging member with respect to a supply roller.

In the embodiment, as shown in FIG. 9, a charging member 104 is disposed to be brought into sliding contact with a supply roller 103 between a demarcation wall 113 and the supply roller 103 on a toner collection path R2. That is, in the embodiment, a developer accommodation chamber 131, the demarcation wall 113, the charging member 104, the supply roller 103 and a developing roller 101 are arranged in this order from the front side to the rear side. As shown in FIG. 10, the charging members 104 are respectively fixed to fixing members 114 disposed on the demarcation wall 113 so as to be brought into sliding contact with both end portions of the supply roller 103, more specifically, the outside of an image formation width W.

Next, operation of the charging member 104 of a developer unit 100 according to the embodiment will be described briefly.

The developing roller 101 and the supply roller 103 rotate and drive in the same direction (counterclockwise direction, arrow direction of FIG. 9) when image formation is started in a state where each of the toners T1, T2, TN, TP described above is present as shown in FIG. 9. Then, by rotation of the supply roller 103, a surface of the supply roller 103 formed of a urethane foamed elastic body is brought into sliding contact with the charging member 104 formed of an ABS resin plate, and a portion in which the supply roller 103 is brought into sliding contact with the charging member 104 is positively charged by friction.

Consequently, the oppositely charged toner TN retained inside a first developing chamber 111A or the oppositely charged toner TN newly generated after the image formation is started is adsorbed to the sliding contact portion of the supply roller 103 positively charged by electrostatic force. By adsorbing the oppositely charged toner TN to the sliding contact portion of the supply roller 103 thus, the oppositely charged toner TN is separated from the positively charged toner TP, so that occurrence of an aggregate is suppressed.

Also, the whole peripheral surface of the sliding contact portion of the supply roller 103 is positively charged by the charging member 104, so that the oppositely charged toner TN is adsorbed on the whole peripheral surface at the sliding contact portion which is positioned outside the image formation width W of the supply roller 103. Consequently, a concentration of the oppositely charged toner TN decreases evenly on the whole peripheral surface of the inside of the image formation width W of the supply roller 103 and occurrence of an aggregate is also suppressed on the whole peripheral surface of the inside of the image formation width W of the supply roller 103.

According to the developer unit 100 according to the embodiment, an effect similar to that of the first embodiment described above can be obtained. Further, in the embodiment, the charging member 104 is arranged on the toner collection path R2 with a high concentration of the deteriorating toner T2 or the oppositely charged toner TN, so that the oppositely charged toner TN can effectively be adsorbed to the sliding contact portion (charged portion) of the supply roller 103. Consequently, a concentration of the oppositely charged toner TN in the first developing chamber 111A can be decreased, and occurrence of an aggregate can be suppressed, so that image quality can be improved. The fixing members 114 can be mounted on the demarcation wall 113, so that a surface opposite to the surface in sliding contact between the supply roller 103 and the charging member 104 can be fixed in a more stable state than the first embodiment described above.

The embodiments of the invention have been described above, but the invention is not limited to the embodiments described above. A concrete configuration can properly be changed without departing from the scope of the invention.

In the embodiments described above, the sheet 3 such as plain paper, heavy paper, a postcard or thin paper has been illustrated as one example of a recording sheet, but is not limited to this and, for example, an OHP sheet or cloth may be used.

In the embodiments described above, the developer unit 100 is detachably attached to the drum unit 30, but is not limited to this and, for example, the developer unit 100 may be integral with the drum unit 30. Also, the drum unit 30 may be integral with the developing case 110A (developing cartridge 110), and the toner case 130A (toner cartridge 130) may be detachably attached to the drum unit 30 and the developing case 110A.

In the embodiments described above, the whole charging member 104 is formed of the ABS resin plate. However, a positively charged portion on a peripheral surface of the supply roller 103 corresponds to a portion sliding contact with the charging member 104. Therefore, the charging member may include the ABS resin plate, for example, at least a portion in sliding contact with the supply roller 103.

In the embodiments described above, the opening 105 is formed over substantially the whole width of the axis direction of the supply roller 103, but is not limited to this. For example, plural openings may be formed with predetermined intervals along the axis direction (right and left directions) of the supply roller 103.

In the embodiments described above, the surface of the supply roller 103 is formed of the urethane foamed elastic body, and the charging member 104 is formed of the ABS resin plate, but the embodiments are not limited to this. As described above, it may be formed of a Teflon (registered trademark) resin or a vinyl chloride resin instead of the ABS resin. Also, for example, the surface of the supply roller may be formed of iron and the charging member may be formed of saran (registered trademark), or the surface of the supply roller may be formed of silicone rubber and the charging member may be formed of polyethylene.

In addition, when the surface of the supply roller is formed of silicone rubber which is an elastic body, by elastic deformation of the supply roller, the supply roller appropriately brought into sliding contact with the charging member, and the charging member can well be charged and also toner can be transported between the supply roller and the charging member.

In the embodiments described above, the surface of the supply roller 103 is formed of the foamed elastic body, but is not limited to this. For example, the charging member 104 may be formed of a foamed elastic body. In this case, it goes without saying that the foamed elastic body of which the charging member is formed is present, on a triboelectric series, on the negative polarity side relative to a material forming (at least a surface of) the supply roller. As one example, the supply roller can be formed of iron and the charging member can be formed of polyurethane foam.

In the embodiments described above, the developing roller 101 and the supply roller 103 rotate in the same direction, but are not limited to this, and rotational directions of the developing roller and the supply roller may be directions opposite to one another.

In the embodiments described above, the charging member 104 is brought into sliding contact with a peripheral surface of the supply roller 103 from one direction, but is not limited to this. The charging member 104 may be brought into sliding contact with the supply roller 103 from plural directions. For example, the configurations of the first and second embodiments described above may be combined.

In the embodiments described above, the agitator 140 is shown as one example of the developer transport member, but is not limited to this. As long as it is developer transport member capable of transporting a developer to the outside of an image formation width, that is, a portion of sliding contact between a supply roller and a charging member, the developer transport member can be used.

In the embodiments described above, the developer accommodation member 100A is formed of two parts of the developing case 110A and the toner case 130A detachably attached to the developing case 110A, but is not limited to this. For example, a developer accommodation member in which the developing case and the toner case (developer case) are integrally constructed may be used. In this case, the supply of a developer can be made by directly supplying a new developer to a developer accommodation chamber formed by the developer accommodation member.

In the embodiments described above, the positively charged toner is shown as one example of the developer, but is not limited to this. For example, even for negatively chargeable toner, the invention can be applied. In addition, in this case, the charging member is formed of a material present, on a triboelectric series, on the positive polarity side relative to a material forming (at least a surface of) the supply roller. For example, the supply roller may be formed of polyurethane foam and the charging member may be formed of aluminum.

EXAMPLE

Next, an example of the invention will be described. In the present example, print experiments were performed using a laser printer (example) with a charging member and a laser printer (comparative example) without a charging member.

Experimental conditions in the example are similar to those of the second embodiment except for a dimension of the charging member and, more specifically, are as follows. In addition, the invention is not limited to the following concrete configurations and the second embodiment.

(1) Toner (a) New Toner

Nonmagnetic, one-component, positively chargeable toner (b) Deteriorating Toner

The deteriorating toner refers to toner remaining in a developer unit (developing chamber) after the print on 12,000 sheets of A4-size plain paper by one developer unit filled with new toner.

(2) Developing Roller

Material: Silicone rubber

Diameter: 20 mm

Width (right and left directions): 236 mm (3) Supply Roller

Material: Urethane

Diameter: 13 mm

Width (right and left directions): 217 mm

Peripheral speed: 145 mm/sec (4) Charging Member (Only Example)

Material: ABS resin plate

Thickness (opposed direction of supply roller and charging member): 1.5 mm

Width (width (axis) direction of supply roller): 30 mm

Length (direction orthogonal to width direction and thickness direction): 10 mm

Arrangement position: Similar to second embodiment. However, the charging member is arranged so as to make sliding contact with only regions of 10 to 40 mm (corresponding to a region X of FIGS. 11A to 11C) and 60 to 90 mm (corresponding to a region Y of FIGS. 11A to 11C) from right of FIGS. 11A to 11C, of a width (217 mm) of the supply roller.

The print experiments were performed on the above conditions. Concretely, after 30 g of deteriorating toner was put into a developing chamber; and a developing roller, a supply roller and an agitator were rotated for one minute; and 100 g of new toner was supplied to a developer supply chamber and white solid printing was done. Its result is shown in FIGS. 11A to 11C and 12A to 12C.

Figure 11A:
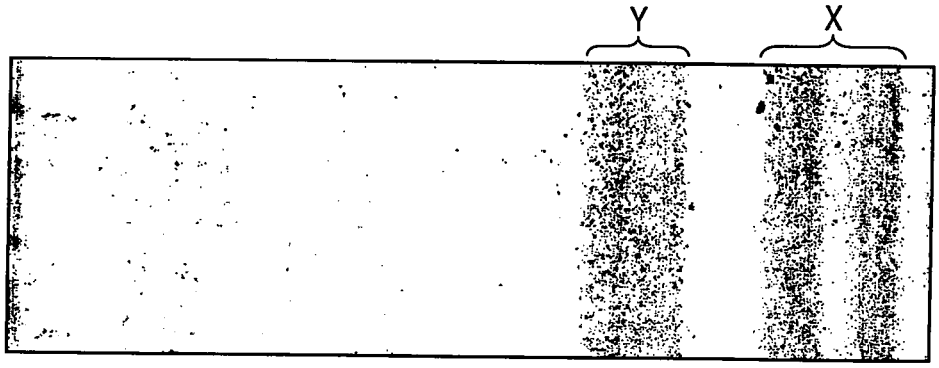
FIGS. 11A to 11C are photographic diagrams showing a part of the sheets after white solid printing is done using a laser printer with a charging member.
Figure 11B:
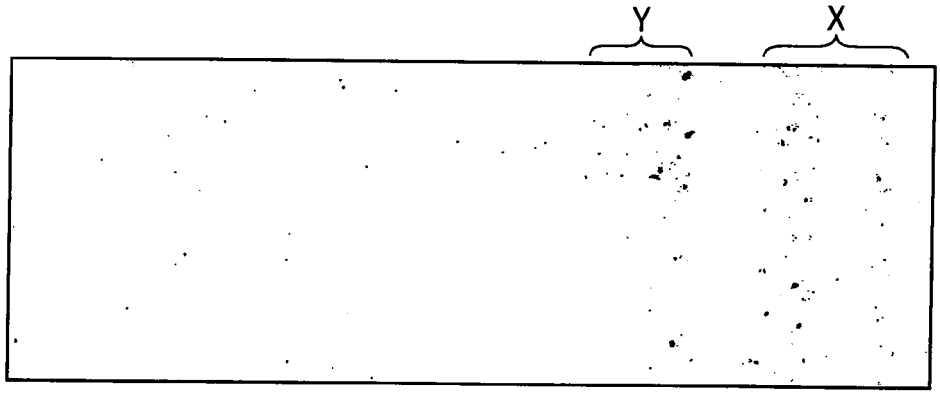
Figure 11C:
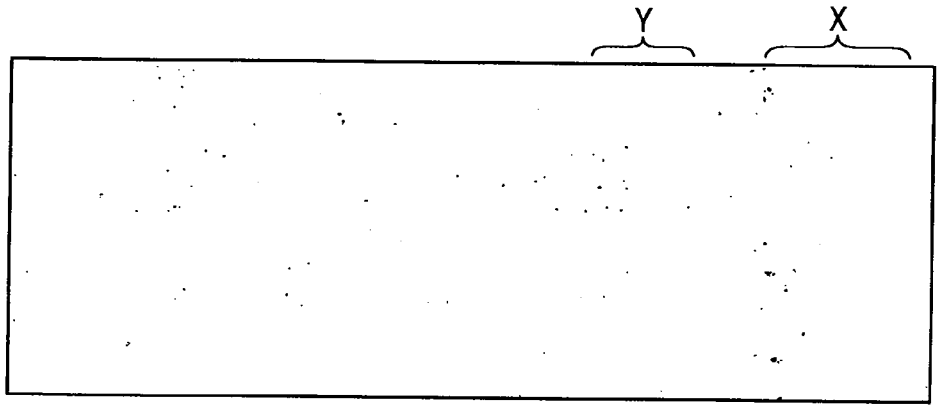
Figure 12A:
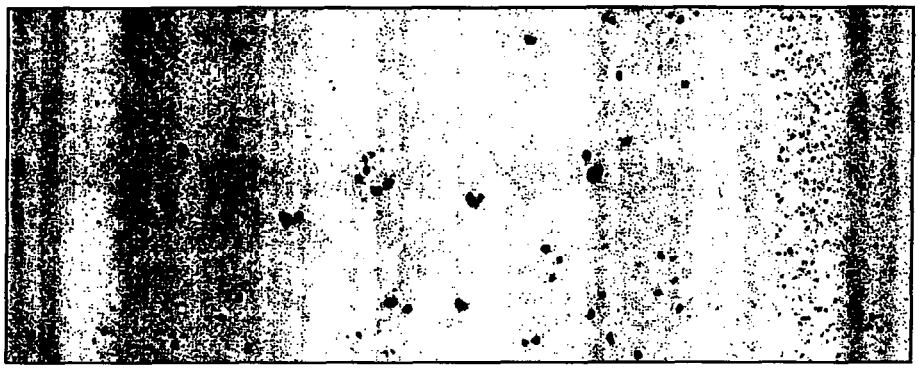
FIGS. 12A to 12C are photographic diagrams showing a part of the sheets after white solid printing is done using a laser printer without a charging member.
Figure 12B:
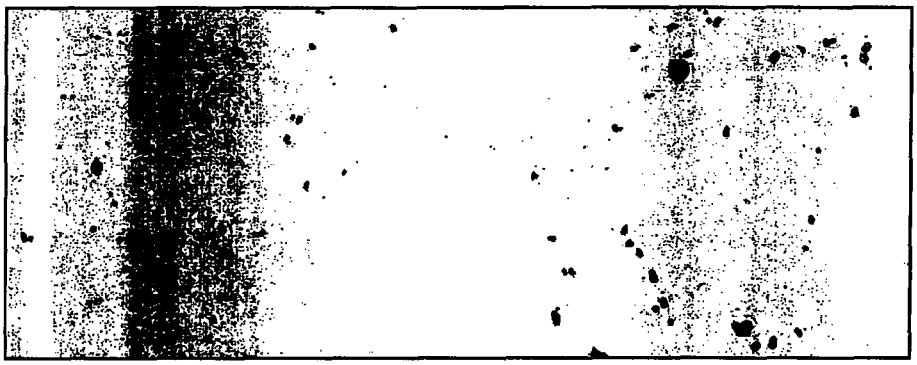
Figure 12C:
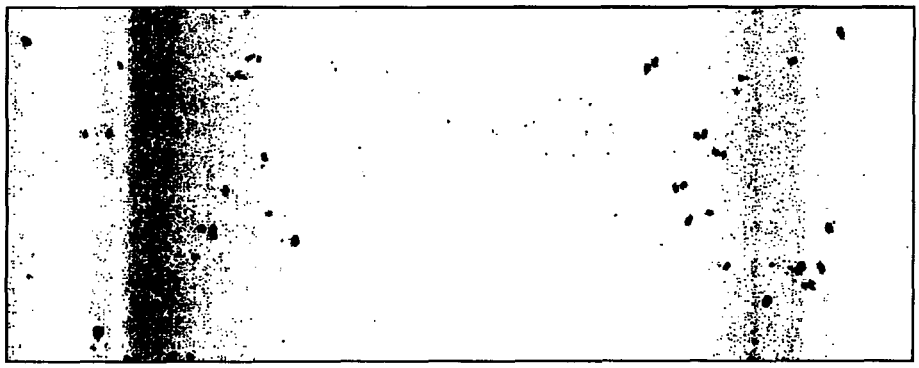

FIGS. 11A to 11C are photographic diagrams each showing a part of the sheets after white solid printing is done using the laser printer of the example. FIGS. 12A to C are photographic diagrams each showing a part of the sheets after white solid printing is done using the laser printer of the comparative example, which is a laser printer without the charging member. In addition, FIGS. 11A and 12A are print results of the first sheet of the printing, FIGS. 11B and 12B are print results of the fifth sheet of the printing, and FIGS. 11C and 12C are print results of the tenth sheet of the printing.

Also, in FIGS. 11A to 11C, the regions X and Y of a sheet width direction (axis direction of the supply roller) are a region corresponding to a portion in which the charging member is brought into sliding contact with the supply roller, and the other region is a region corresponding to a portion in which the charging member is not brought into sliding contact with the supply roller. The regions X and Y correspond to "the outside of an image formation width of the supply roller" of the embodiments.

Here, the "white solid printing" refers to printing done in a state in which an electrostatic latent image is not formed on a photoconductor drum. In addition, in FIGS. 9 and 10, upper and lower directions of a paper surface correspond to a conveying direction of a sheet, and right and left directions of a paper surface correspond to a width direction of a sheet.

A remarkable improvement in image quality was found in the portion with which the charging member is not brought into sliding contact particularly in the print result of the first sheet of the printing shown in FIG. 11A as a result of doing the white solid printing using the laser printer of the example as shown in FIGS. 11A to 11C. In addition, improvements in image quality were also found in the regions X and Y by increasing the number of prints as shown in FIGS. 11B and 11C.

On the other hand, as a result of doing the white solid printing using the laser printer of the comparative example as shown in FIGS. 12A to 12C, black spots probably due to influence of an aggregate occurred more than those of the example shown in FIGS. 11A to 11C. Also, a size of the black spot in the comparative example was larger than that of the example, and a reduction in image quality was found. In addition, the improvement in image quality by increasing the number of prints was similar to the example, but it was found that its extent was insufficient as compared with the example.

It was found that image quality could be improved more by bringing the charging member having the properties as described above into sliding contact with the supply roller from the above description.

In addition, it was apparent from the experimental results described above that a reduction in image quality due to occurrence of an aggregate became a problem particularly just after (that is, for example, the first sheet of printing than the fifth sheet of printing) toner supply after a toner cartridge is replaced or just after new toner is supplied to the inside of a developer accommodation chamber. Therefore, the charging member described above may be brought into sliding contact with the supply roller for only a predetermined period starting from the supply of a developer to a developer accommodation chamber or from the attachment of a developer case to a developing case, and then may be separated from the supply roller after a lapse of the predetermined time.

Also, as shown in FIG. 11A, a reduction in image quality was found in the portion (regions X and Y corresponding to "the outside of an image formation width of the supply roller" of the invention) with which the charging member is brought into sliding contact as compared with the portion with which the charging member is not brought into sliding contact. Therefore, it is particularly desirable that the outside of the image formation width described above be the outside than a width WS of right and left directions of the sheet 3 as shown in FIG. 2. Similarly, in order to avoid such a reduction in image quality, a width of an axis direction of a roller portion of a developing roller (and/or an image carrier) may be made smaller than a distance (axis direction) of the charging member disposed in the outside of the image formation width of the supply roller.

What is claimed is:

1. A developer unit comprising:

a developer accommodation member configured to accommodate a developer, the developer having charging polarity to a first polarity that is opposite to a second polarity;

a developing roller arranged at the developer accommodation member, the developing roller being configured to carry the developer;

a supply roller arranged at the developer accommodation member, the supply roller being configured to supply the developer to the developing roller, an image formation width being defined on a surface of the supply roller along an axis direction of the supply roller; and a charging member brought into sliding contact with an outside of the image formation width of the supply roller, wherein the charging member at a portion brought into sliding contact with the supply roller is formed of a material which is positioned on a side of the second polarity on a triboelectric series relative to the supply roller.

2. The developer unit according to claim 1, wherein the developer accommodation member has an opening that allows a developing chamber to communicate with a developer accommodation chamber, the developing chamber at which the developing roller and the supply roller are arranged, and the developer accommodation chamber configured to accommodate the developer therein; and wherein the opening extends along the axis direction wider than the image formation width.

3. The developer unit according to claim 2, wherein the developer accommodation member comprises a developer transport member configured to transport the developer toward the outside of the image formation width with respect to the axis direction.

4. The developer unit according to claim 3, wherein the developer transport member comprises:

a shaft having a rotation axis along the axis direction and rotatable in a rotation direction; and a plurality of vanes attached to the shaft with intervals along the axis direction, and wherein each of the vanes has a peripheral edge extending from a first end to a second end, the first end being positioned upstream from the second end with respect to the rotation direction, the second end being positioned nearer a center of the shaft with respect to the axis direction than the first end.

5. The developer unit according to claim 1, wherein one of the supply roller and the charging member is formed of a foamed elastic body.

6. The developer unit according to claim 1, wherein the supply roller and the developing roller are configured to rotate in a same direction.

7. The developer unit according to claim 6, wherein the developer accommodation member comprises:

a first wall surface that defines a developing chamber at which the developing roller and the supply roller are arranged;

a second wall surface that defines a developer accommodation chamber communicating with the developing chamber and configured to accommodate the developer therein; and a demarcation portion that demarcates the developer accommodation chamber and the developing chamber, and wherein the charging member is arranged in a developer collection path formed between the supply roller and the demarcation portion.

8. The developer unit according to claim 7, wherein the developer accommodation chamber, the demarcation portion, the charging member, the supply roller and the developing roller are arranged in the developer accommodation member in this order.

9. The developer unit according to claim 6, wherein the developer accommodation member comprises a demarcation portion that demarcates a developing chamber and a developer accommodation chamber, the developing chamber at which the developing roller and the supply roller are arranged, and the developer accommodation chamber communicating with the developing chamber and configured to accommodate the developer therein, and wherein the charging member is arranged on a downstream side in a rotation direction from a merging portion, the merging portion being defined at a position where a developer collection path and a developer supply path merge, the developer collection path being defined between the supply roller and the demarcation portion, and the developer supply path being defined from the developer accommodation chamber to the developing chamber.

10. The developer unit according to claim 1, wherein the developer accommodation member is divided into two parts comprising:

a developing case that defines a developing chamber at which the developing roller and the supply roller are arranged; and a developer case that defines a developer accommodation chamber communicating with the developing chamber and configured to accommodate the developer therein, and wherein the developer case is detachable from the developing case.

11. The developing unit according to claim 1, wherein the charging member is brought into sliding contact only with the supply roller at the outside of the image formation width.

12. The developing unit according to claim 1, wherein the portion of the charging member brought into sliding contact with the supply roller is formed of a resin.

13. A process device comprising:

a developer unit, wherein the developer unit comprises:

a developer accommodation member configured to accommodate a developer, the developer having charging polarity to a first polarity that is opposite to a second polarity;

a developing roller arranged at the developer accommodation member, the developing roller being configured to carry the developer;

a supply roller arranged at the developer accommodation member, the supply roller being configured to supply the developer to the developing roller, an image formation width being defined on a surface of the supply roller along an axis direction of the supply roller; and a charging member brought into sliding contact with an outside of the image formation width of the supply roller, wherein the charging member at a portion brought into sliding contact with the supply roller is formed of a material which is positioned on a side of the second polarity on a triboelectric series relative to the supply roller; and an image carrier on which the developer is supplied from the developer unit and a developer image is formed.

14. The process device according to claim 13, wherein the charging member is brought into sliding contact only with the supply roller at the outside of the image formation width.

15. The process device according to claim 13, wherein the portion of the charging member brought into sliding contact with the supply roller is formed of a resin.

16. An image forming apparatus capable of forming an image on a recording sheet, the image forming apparatus comprising:

a process device comprising a developer unit and an image carrier on which a developer is supplied from the developer unit and a developer image is formed, the developer unit comprising:

a developer accommodation member configured to accommodate a developer, the developer having charging polarity to a first polarity that is opposite to a second polarity;

a developing roller arranged at the developer accommodation member, the developing roller being configured to carry the developer;

a supply roller arranged at the developer accommodation member, the supply roller being configured to supply the developer to the developing roller, an image formation width being defined on a surface of the supply roller along an axis direction of the supply roller; and a charging member brought into sliding contact with an outside of the image formation width of the supply roller, wherein the charging member at a portion brought into sliding contact with the supply roller is formed of a material which is positioned on a side of the second polarity on a triboelectric series relative to the supply roller;

an exposure device configured to expose the image carrier of the process device and form an electrostatic latent image on the image carrier;

a transfer device configured to transfer a developer image formed by the process device to the recording sheet; and a fixing device configured to fix an image formed on the recording sheet.

17. The image forming apparatus of claim 16, wherein the charging member is brought into sliding contact only with the supply roller at the outside of the image formation width.

18. The image forming apparatus according to claim 16, wherein the portion of the charging member brought into sliding contact with the supply roller is formed of a resin.

* * * * *